US010151447B2

(12) United States Patent
Suzuki et al.

(10) Patent No.: US 10,151,447 B2
(45) Date of Patent: Dec. 11, 2018

(54) LIGHTING DEVICE USING LIGHT-EMITTING ELEMENTS AS LIGHT SOURCE

(71) Applicant: PANASONIC INTELLECTUAL PROPERTY MANAGEMENT CO., LTD., Osaka (JP)

(72) Inventors: Masae Suzuki, Saitama (JP); Ryuji Hotta, Tokyo (JP); Masaki Tada, Tokyo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/864,540

(22) Filed: Jan. 8, 2018

(65) Prior Publication Data

US 2018/0195688 A1 Jul. 12, 2018

(30) Foreign Application Priority Data

Jan. 10, 2017 (JP) ..... 2017-001632

(51) Int. Cl.

| | |
|---|---|
| ***F21V 7/00*** | (2006.01) |
| ***F21V 7/22*** | (2018.01) |
| ***F21V 11/16*** | (2006.01) |
| ***F21V 3/00*** | (2015.01) |
| *A47F 3/00* | (2006.01) |
| *F21Y 115/10* | (2016.01) |
| *F21V 7/06* | (2006.01) |
| *F21Y 103/10* | (2016.01) |

(52) U.S. Cl.

CPC ..... *F21V 7/22* (2013.01); *F21V 3/00* (2013.01); *F21V 11/16* (2013.01); *A47F 3/001* (2013.01); *F21V 7/06* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS

2012/0206911 A1* 8/2012 Pickard ..... F21S 8/026 362/231

2014/0167645 A1 6/2014 Takahashi et al.

FOREIGN PATENT DOCUMENTS

JP 2014-120396 A 6/2014

WO WO 2017/175858 A1 * 10/2017 ..... F21V 29/70

* cited by examiner

*Primary Examiner* — Sharon E Payne

(74) *Attorney, Agent, or Firm* — Greenblum & Bernstein, P.L.C.

(57) ABSTRACT

A lighting device includes a light source and first and second reflection surfaces. The first reflection surface reflects source light from the light source, and projects first light on first and second regions on an illuminated surface. The second region is closer to the lighting device than the first region. The second reflection surface is tinted in a prescribed color, and reflects secondary and higher-order reflection light of the source light, and projects second light on the second region. An absolute value of a difference between correlated color temperatures of the first light projected on the first region and of mixed light of the first and second lights projected on the second region is smaller than an absolute value of a difference between correlated color temperatures of the first light projected on the first region and of the first light projected on the second region.

7 Claims, 6 Drawing Sheets

LIGHTING DEVICE USING LIGHT-EMITTING ELEMENTS AS LIGHT SOURCE

BACKGROUND

Technical Field

This disclosure relates to a lighting device which uses light-emitting elements such as light-emitting diodes (LEDs) as its light source.

Background Art

There is a lighting device that can change the color of illumination light by using multiple types of light-emitting elements that provide different emission colors from one another, and adjusting outputs from the respective light-emitting elements. Japanese Unexamined Patent Application Publication No. 2014-120396 discloses a related art.

However, the lighting device using multiple types of the light-emitting elements which have correlated color temperatures of emitted light being different from each other may cause color unevenness on an illuminated surface due to factors such as variations in light distribution characteristics, optical axis deviations, displacements of mounting positions, and the like among the light-emitting elements.

SUMMARY

This disclosure has been made in view of the problem of the related art. An object of this disclosure is to efficiently suppress the color unevenness on the illuminated surface.

A lighting device according to an aspect of this disclosure includes: a light source in which two or more types of light-emitting elements that have correlated color temperatures of emitted light being different from each other are arranged in one direction; a first reflection surface; and a second reflection surface. The first reflection surface reflects source light emitted from the light source, and projects first light that is the reflected source light, on first and second regions on a surface illuminated by the lighting device, the second region being located closer to the lighting device than the first region. The second reflection surface reflects secondary and higher-order reflection light of the source light, and projects second light that is the reflected secondary and higher-order reflection light, on the second region. The second reflection surface is tinted in a prescribed color. An absolute value of a difference between a correlated color temperature of the first light projected on the first region and a correlated color temperature of mixed light of the first and second lights projected on the second region is smaller than an absolute value of a difference between the correlated color temperature of the first light projected on the first region and a correlated color temperature of the first light projected on the second region.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Figure 1:
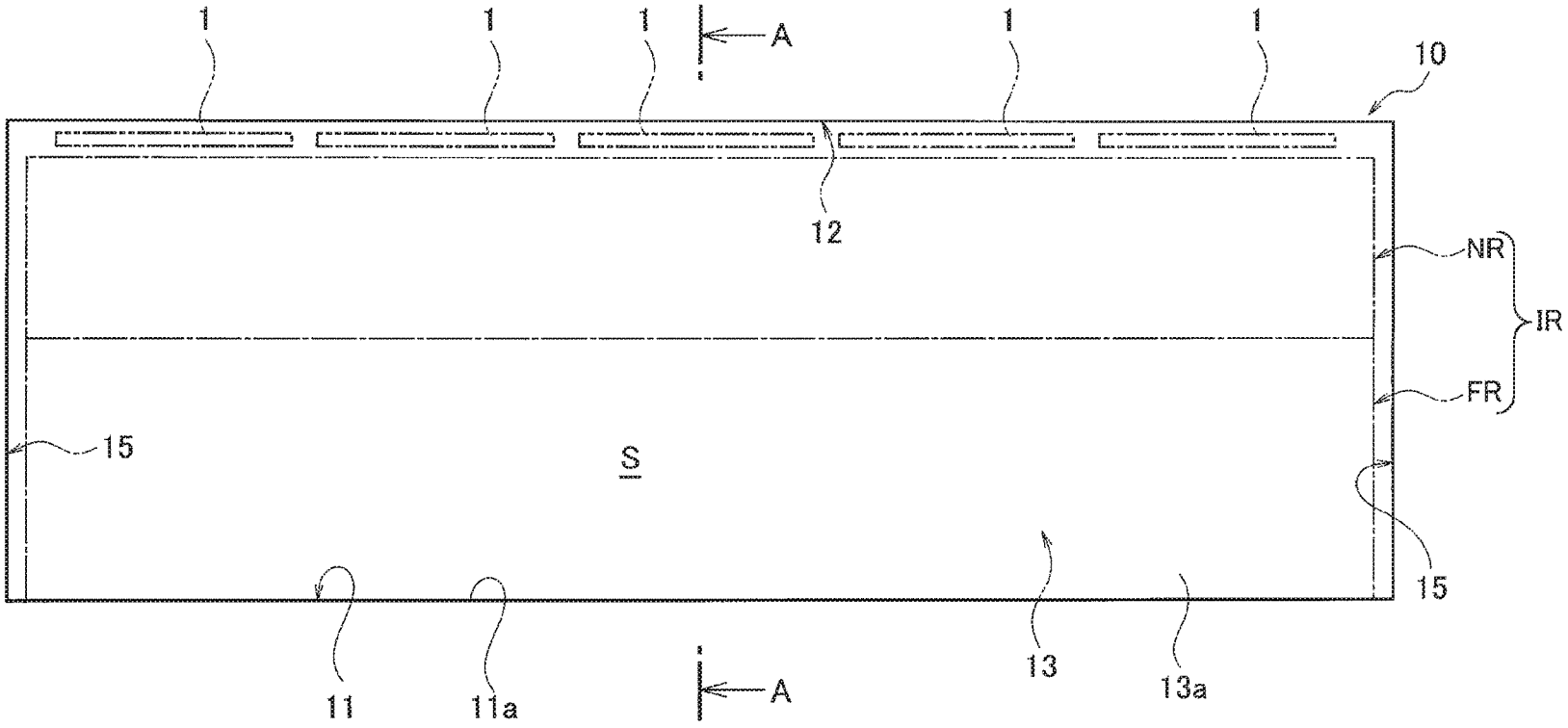
FIG. 1 is a layout drawing of a lighting device according to an embodiment of this disclosure.

Embodiments of the present disclosure will be described below with reference to the drawings. It is to be noted that the terms indicating directions such as "above", "below", "front", and "back" are defined for the sake of the illustration of positional relations of components and are not intended to restrict conditions such as orientations to attach the components in an actual device.

As shown in FIGS. 1 to 4, a lighting device 1 can be installed in a showcase 10 which is used, for example, in a gallery, a museum, and the like. The showcase 10 includes a display table 11, a top wall 12, a back wall 13, a front wall 14, and right and left side walls 15, and defines a display space S inside. The front wall 14 is provided with a transparent panel 14*a* which makes the display space S visible from a position in front of the showcase 10. An upper shield wall 14*b* and a lower shield wall 14*c* are provided above and below the transparent panel 14*a*. A showpiece such as a painting and a sculpture is displayed by being hung on a front face 13*a* of the back wall 13 or being placed on an upper face 11*a* of the display table 11.

Figure 5:
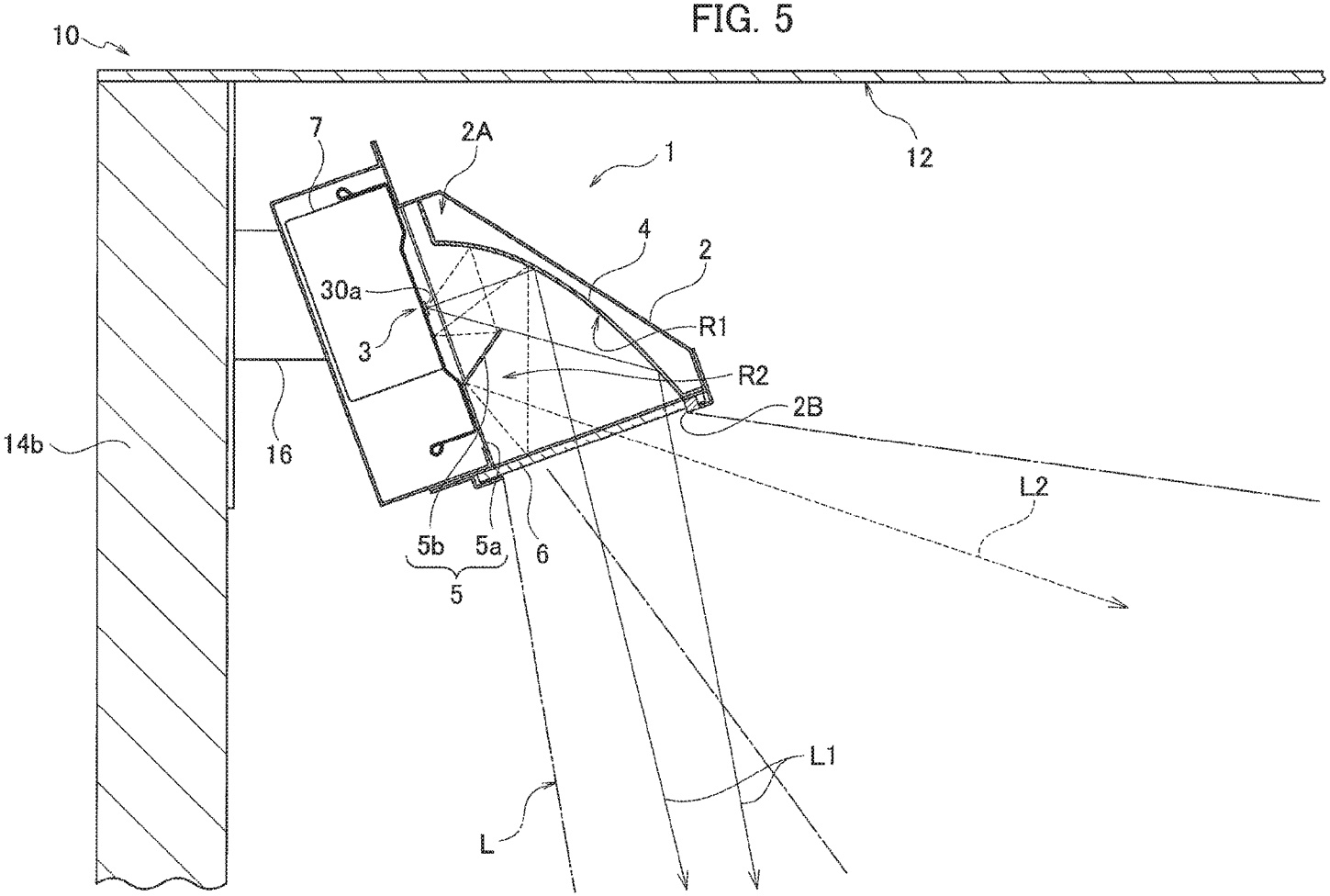
FIG. 5 is a cross-sectional view of the lighting device according to the embodiment.

As shown in FIG. 1, for example, multiple lighting devices 1 are installed substantially across the entire length of the display space S. The lighting devices 1 have an elongated shape and are arranged to extend at a position in front of the back wall 13 substantially parallel to the front face 13*a* thereof. As shown in FIG. 5, for example, each lighting device 1 can be fixed to a rear side face of the upper shield wall 14*b* with a fixture 16 such as an attachment bracket.

Figure 2:
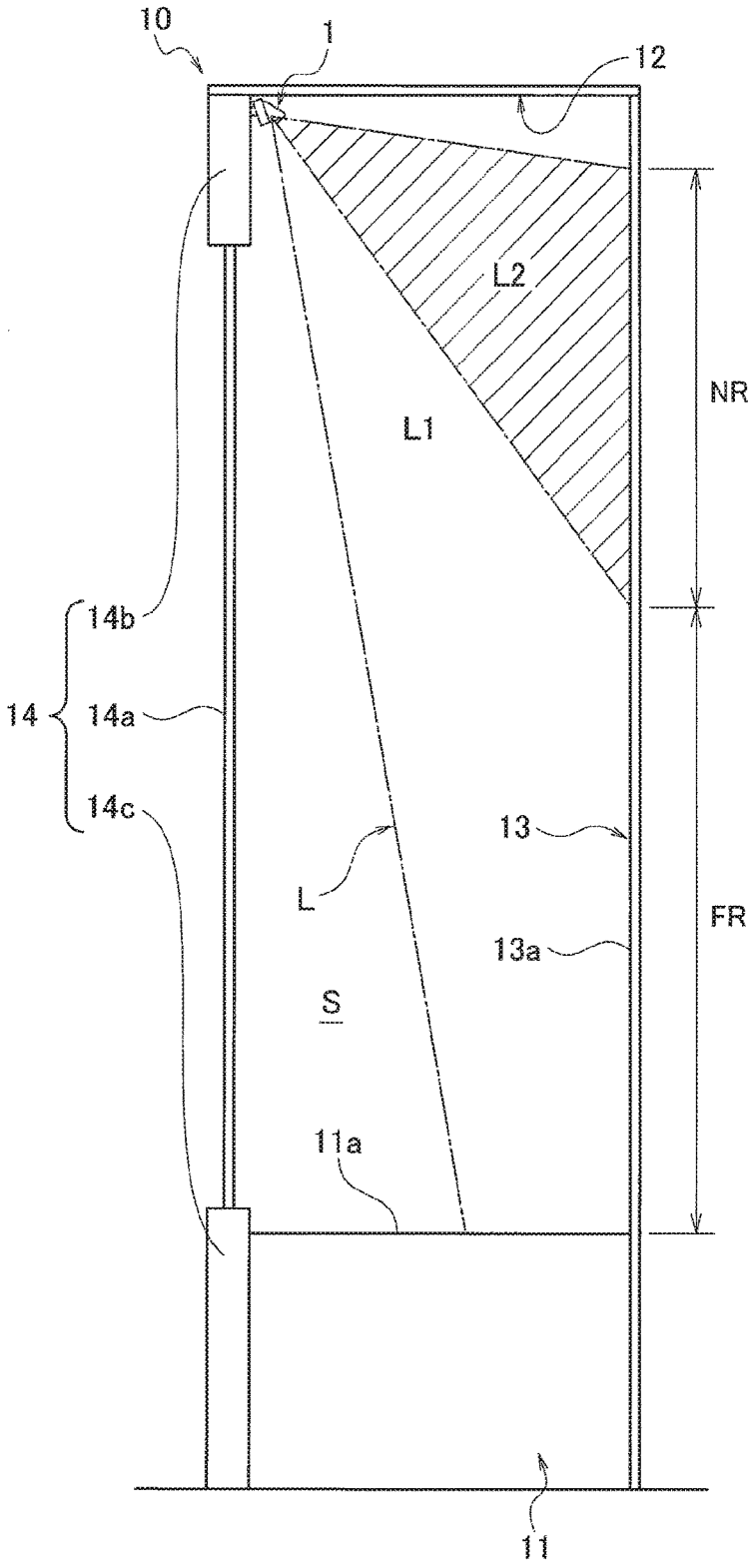
FIG. 2 is a cross-sectional view taken along the A-A line in FIG. 1.

As shown in FIG. 2, the illumination light L emitted from the lighting device 1 is projected from the front and above the back wall 13 toward the front face 13*a* of the back wall 13, and is made incident obliquely on the front face 13*a* of the back wall 13. Part of the illumination light L may be projected on the upper face 11*a* of the display table 11. As shown in FIG. 1, the illumination light L is projected on substantially the entire region of the front face 13*a* of the back wall 13. Here, the region of the front face 13*a* of the back wall 13 where the illumination light L reaches will be referred to as an illuminated surface IR. The illumination light L is distributed onto the illuminated surface IR in such a way as to achieve a desired uniformity ratio. In the meantime, a correlated color temperature of the illumination light L is adjusted so as to be substantially uniform over almost the entire region on the illuminated surface IR. In the case of an application to the showcase 10, the uniformity ratio (a ratio between minimum illuminance and maximum illuminance) is preferably equal to or above 0.75, and a variation in correlated color temperature (a difference between a maximum value and a minimum value of the correlated color temperature) on the illuminated surface IR is preferably equal to or below 100 K.

As shown in FIGS. 1 to 4, the illuminated surface IR is segmented into a far region FR (a first region) located at a position distant from the lighting device 1, and a near region NR (a second region) located closer to the lighting device 1 than the far region FR is. When the lighting device 1 is provided above the display space S as in this embodiment, the far region FR occupies a region on a lower side of the illuminated surface IR while the near region NR occupies a region on an upper side of the illuminated surface IR. Each of the far region FR and the near region NR defines a strip region that extends in a horizontal direction across substantially the entire length of the display space S in front view.

As shown in FIG. 5, the lighting device 1 includes a housing 2, a light source 3, a reflector plate 4, a light shielding plate 5, and a diffuser panel 6.

The housing 2 is an elongated hollow member formed from a thin plate made of a metal such as aluminum, a resin, or the like. A housing space 2A formed into a trapezoidal shape on a cross section perpendicular to a longitudinal direction of the lighting device 1 is provided inside the housing 2. The light source 3, the reflector plate 4, and the light shielding plate 5 are housed in the housing space 2A. A lower surface of the housing 2 is provided with a light projection opening 2B, which is opened downward (to the illuminated surface IR side), and the diffuser panel 6 is attached to the light projection opening 2B.

Figure 6:
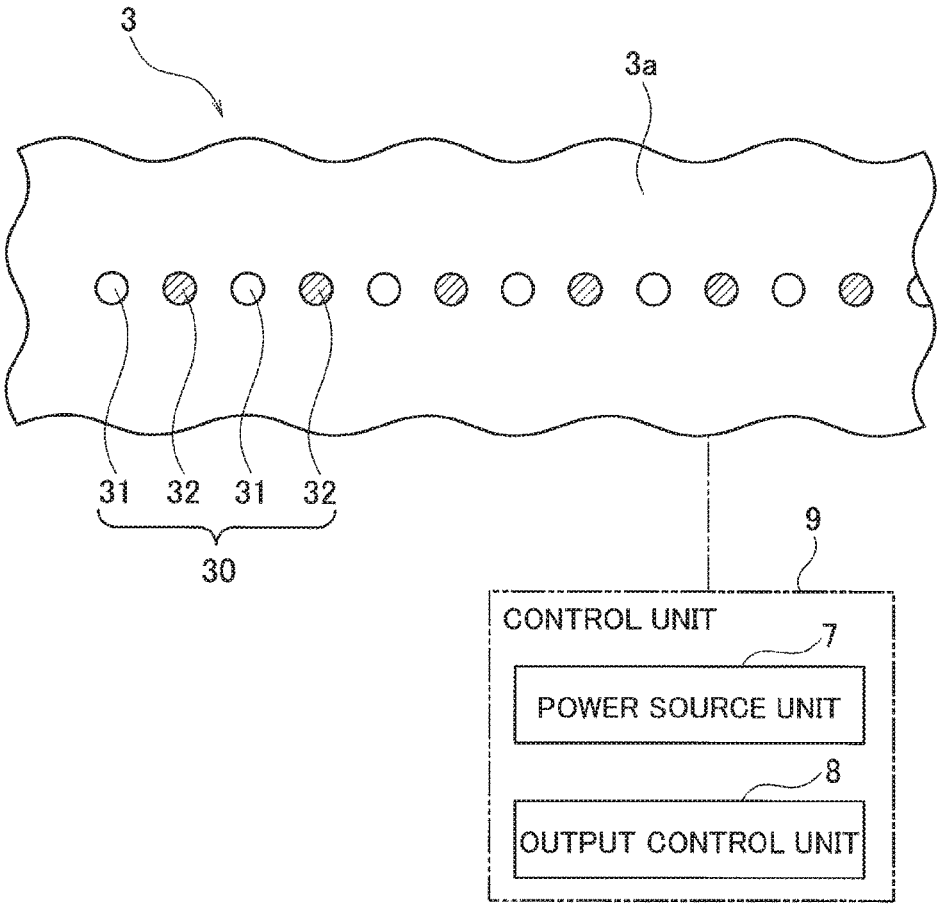
FIG. 6 is a layout drawing of LEDs in a light source according to the embodiment.

The light source 3 is a linear light source formed from multiple LEDs 30 (light-emitting elements) mounted on a base plate 3*a*. The base plate 3*a* is fixed to the housing 2 while allowing its surface mounting the multiple LEDs 30 to be directed backward (directed to the illuminated surface IR side). A power source unit 7 formed from electronic components and the like for supplying electric power to the LEDs 30 is provided on a rear surface side (a front side) of the base plate 3*a*. The multiple LEDs 30 include first LEDs 31 (first light-emitting elements) and second LEDs 32 (second light-emitting elements), which have correlated color temperatures of emitted light being different from each other. The lighting device 1 employs mixture of light emitted from the LEDs 31 and 32 as source light. As shown in FIG. 6, the first and second LEDs 31 and 32 are arranged alternately and at regular intervals in a line along the longitudinal direction of the lighting device 1. In this way, light distribution control of the illumination light L is facilitated by reducing a width of the light source 3. Note that the number of rows of the LEDs 30 (31 and 32) is not limited to a particular value, and it is possible to provide the LEDs 30 in two or more rows within a range not to complicate the light distribution control too much.

Meanwhile, the lighting device 1 includes a control unit 9 (see FIG. 6), which controls light outputs from the first and second LEDs 31 and 32. The control unit 9 includes the power source unit 7, and an output control unit 8 which controls the light outputs from the respective LEDs 31 and 32. The output control unit 8 can be realized by a microcomputer, a processor, a dedicated circuit, and the like. The output control unit 8 may include a central processing unit (CPU), a memory (such as a non-volatile memory), and the like. A program for realizing functions of the output control unit 8 is stored in the memory. The program may be recorded in the memory in advance. Alternatively, the program may be provided by being recorded in a recording medium (such as a memory card) or provided via an electrical communication line (such as the Internet). The control unit 9 causes the output control unit 8 to adjust a light output ratio between the LEDs 31 and 32, thereby making the correlated color temperature of the mixed light emitted from the light source 3 variable in a range from 3000 K to 5000 K, for example.

The reflector plate 4 is disposed at a position closer to the illuminated surface IR than is the light source 3 in such a way as to cover the upper and back parts of the light source 3, and is thus fixed to the housing 2. A lower end portion of the reflector plate 4 is opened downward to form the light projection opening 2B. The reflector plate 4 includes a specular reflection surface R1 (a first reflection surface) located on the surface on the light source 3 side. The specular reflection surface R1 extends in the longitudinal direction of the lighting device 1 (a direction of extension of the light source 3), and has a substantially parabolic curved shape in terms of a cross section perpendicular to the longitudinal direction of the lighting device 1. The reflector plate 4 can be formed from a metal such as aluminum and stainless steel, a resin, or the like. The specular reflection surface R1 can be formed by subjecting the surface on the light source 3 side of the reflector plate 4 to mirror finishing, or by coating or vapor-depositing a reflective material thereon.

Figure 3:
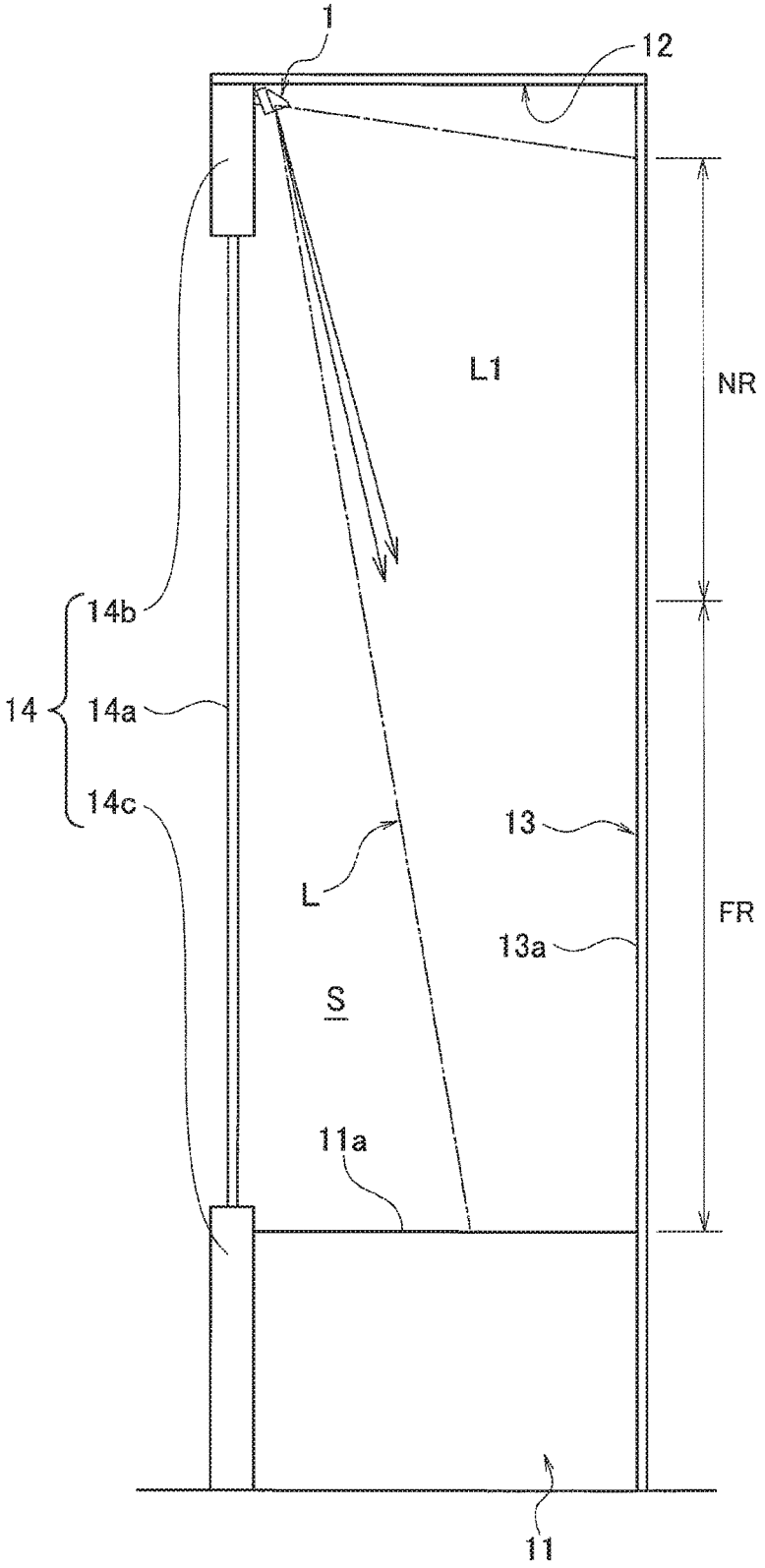
FIG. 3 is a diagram showing a projection region of first light from the lighting device according to the embodiment.

As shown in FIGS. 3 and 5, the specular reflection surface R1 performs specular reflection of the source light and projects first light L1 onto the far region FR and the near region NR through the diffuser panel 6. The first light L1 projected on the far region FR and the first light L1 projected on the near region NR may cause a difference in correlated color temperature (hereinafter referred as "uneven color temperatures"), which is attributed to variations in light distribution characteristics, optical axis deviations, displacements of mounting positions, and the like among the LEDs 31 and 32, for example. The uneven color temperatures cause color unevenness on the illuminated surface IR. In this embodiment, the correlated color temperature of the first light L1 projected on the far region FR is set lower than the correlated color temperature of the first light L1 projected on the near region NR. Here, the correlated color temperature of the first light L1 projected on each of the far region FR and the near region NR can be measured, for example, by covering an auxiliary reflection surface R2 to be described later with a low-reflectance plate subjected to a blackening surface treatment and the like, or by replacing the light shielding plate 5 with this plate and the like.

The light shielding plate 5 is disposed between the light source 3 and the diffuser panel 6, and is fixed to the housing 2. The light shielding plate 5 is formed from a thin plate of a metal, a resin, and the like, and is bent into an L-shape on the cross section perpendicular to the longitudinal direction of the lighting device 1. The light shielding plate 5 includes a base portion 5*a* and a light shielding portion 5*b*. The base portion 5*a* is fixed to the housing 2 while extending substantially parallel to the base plate 3*a* at a position below the light source 3. The light shielding portion 5*b* is erected on an upper end of the base portion 5*a* toward the reflector plate 4, and is configured to suppress the projection of the source light on the far region FR and the near region NR without being reflected from the specular reflection surface R1 (i.e., to prevent direct incidence of the source light on the diffuser panel 6 through the light projection opening 2B).

Figure 4:
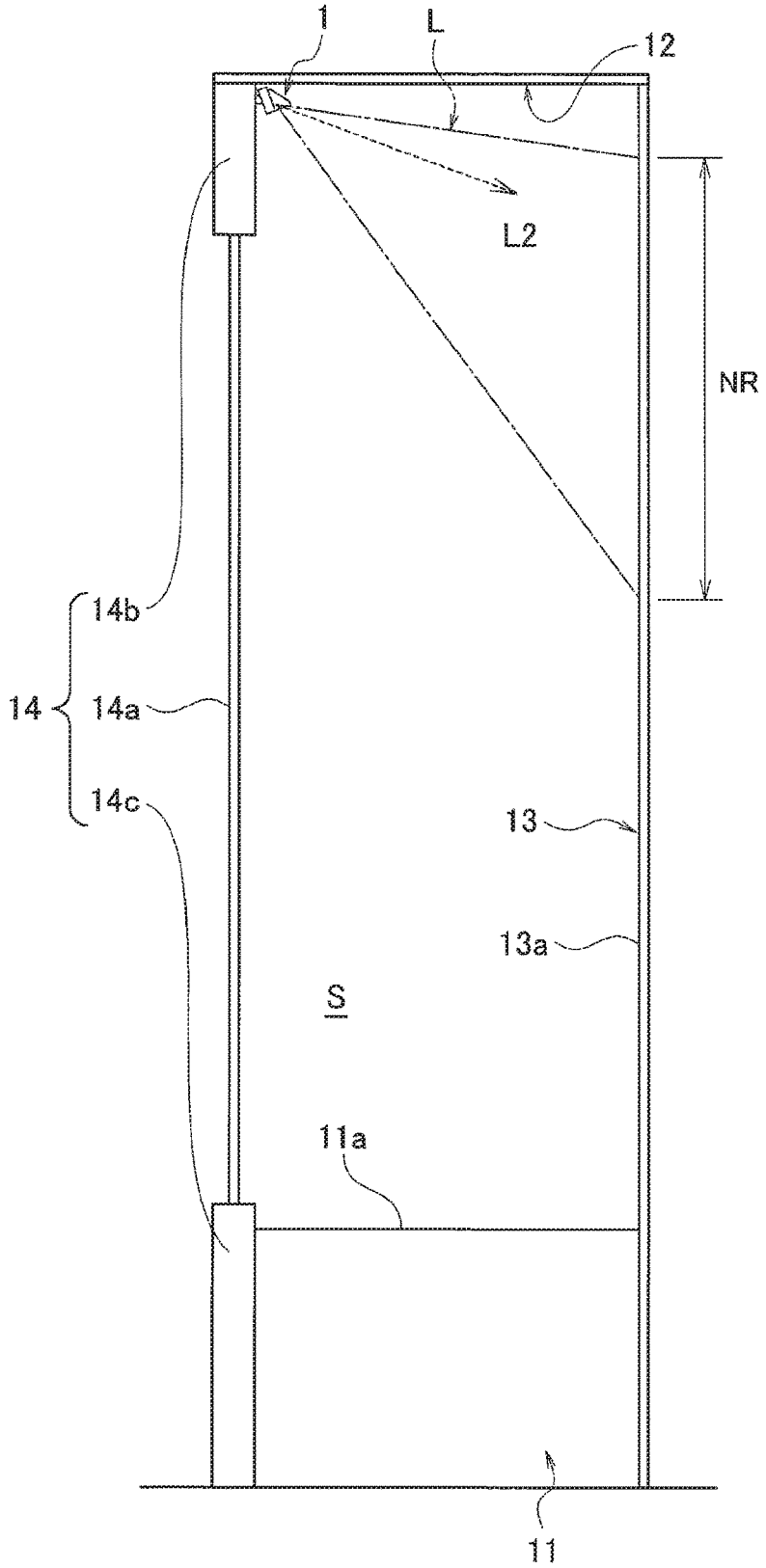
FIG. 4 is a diagram showing a projection region of second light from the lighting device according to the embodiment.

The light shielding plate 5 also functions as an auxiliary reflector plate. A surface of the light shielding portion 5*b* on the opposite side from the light source 3 and a surface of the base portion 5*a* on the specular reflection surface R1 side collectively constitute the auxiliary reflection surface R2 (a second reflection surface), which extends in the longitudinal direction of the lighting device 1 (the direction of extension of the light source 3). The auxiliary reflection surface R2 is provided in the housing 2 at a position opposed to the near region NR through the diffuser panel 6. As shown in FIGS. 4 and 5, the auxiliary reflection surface R2 reflects secondary and higher-order reflection light of the source light (which may contain primary and higher-order reflection light of the first light L1) inside the housing 2, and projects second light L2 on the near region NR. In other words, mixed light of the first light L1 and the second light L2 is projected on the near region NR.

The auxiliary reflection surface R2 is tinted in a prescribed color. For this reason, a correlated color temperature of the second light L2 is different from the correlated color temperature of the first light L1. The prescribed color is selected such that an absolute value of the difference in correlated color temperature between the mixed light projected on the near region NR (a hatched portion in FIG. 2) and the first light L1 projected on the far region FR is smaller than the magnitude of the above-mentioned uneven color temperatures of the first light L1. In other words, the lighting device 1 generates the light (the second light L2) to reduce the difference in correlated color temperature of the light projected on the two regions FR and NR on the illuminated surface IR by tinting the second reflection surface in the prescribed color. Here, any of well-known surface treatment methods including painting, plating, thermal spraying, vapor deposition, and the like may be employed as the tinting method.

In this embodiment, the color of the auxiliary reflection surface R2 is selected such that an average value of the correlated color temperature of the second light L2 is lower than an average value of the correlated color temperature of the first light L1 (such that the former exhibits a warmer color than the latter). For example, when the average value of the correlated color temperature of the first light L1 is around 4000 K, it is possible to provide the auxiliary reflection surface R2 with ivory matte paint (Munsell 2.5Y 9/2, which corresponds to 22-90D according to JPMA). Thus, it is possible to set the average value of the correlated color temperature of the second light L2 lower than the average value of the correlated color temperature of the first light L1.

In the meantime, the color of the auxiliary reflection surface R2 may be selected such that the average value of the correlated color temperature of the second light L2 is lower than the average value of the correlated color temperature of the first light L1, when the correlated color temperature of the source light is equal to a median value (such as 4000 K) of its variable range (such as from 3000 K to 5000 K). Here, the "average value" of the correlated color temperature means an average value in an illuminated region on the illuminated surface IR. Accordingly, the average value of the correlated color temperature of the first light L1 represents an average value of the correlated color temperature of the first light L1 on the entirety of the far region FR and the near region NR. Meanwhile, the average value of the correlated color temperature of the second light L2 represents an average value of the correlated color temperature of the second light L2 on the entirety of the near region NR. These average values can be calculated, for example, as average values of the correlated color temperatures measured at finite numbers of representative points in the regions FR and NR, respectively. Note that the correlated color temperature of the second light L2 can be obtained by ng the component of the first light L1 from the mixed light of the first light L1 and the second light L2 to be projected on the near region NR, for example.

The diffuser panel 6 performs diffuse projection of the first light L1, which is incident from the specular reflection surface R1, toward the far region FR and the near region NR, and performs diffuse projection of the second light L2, which is incident from the auxiliary reflection surface R2, toward the near region NR. Part of the light incident on the diffuser panel 6 is reflected from the diffuser panel 6, and is transformed into the secondary and higher-order reflection light in the housing 2. The diffuser panel 6 can be formed, for example, from a transparent panel and a diffuser sheet attached to an outer surface of the transparent panel. For example, a matte translucent panel made of acrylic resin can be employed as the transparent panel. For instance, LEE 251 (manufactured by LEE Filters) can be employed as the diffuser sheet. The uniformity ratio on the illuminated surface IR can be improved by installing the diffuser panel 6. Here, the diffuser panel 6 may be omitted when a sufficient uniformity ratio can be obtained by using the specular reflection surface R1 and the auxiliary reflection surface R2.

Operation and effect of this embodiment will be described below.

When the light source 3 applies the first and second LEDs 31 and 32 which have the correlated color temperatures of the emitted light being different from each other, the illumination light L may cause uneven color temperatures, which are attributed to the variations in light distribution characteristics, the optical axis deviations, the displacements of mounting positions, and the like among the LEDs 31 and 32, for example. The uneven color temperatures cause the above-mentioned color unevenness on the illuminated surface IR. In particular, the linear light source such as the light source 3 has a ratio of the width (a widening rate) of the illuminated surface IR to the width of the light source, which is greater than that of a planar light source. Accordingly, the uneven color temperatures tend to be amplified more. It is difficult to sufficiently suppress the uneven color temperatures even by use of the diffuser panel 6.

In the lighting device 1, the light (the second light L2) designed to reduce the difference in correlated color temperature between the light projected on the far region FR of the illuminated surface IR and the light projected on the near region NR thereof is generated by tinting the auxiliary reflection surface R2 in the prescribed color, and then the generated light is projected on the near region NR. Accordingly, it is possible to reduce the uneven color temperatures of the light projected on the far region FR and the near region NR by using a simple structure, and thus to efficiently suppress the color unevenness on the illuminated surface IR.

Meanwhile, in this embodiment, the correlated color temperature of the first light L1 projected on the far region FR is set lower than the correlated color temperature of the first light L1 projected on the near region NR. On the other hand, the color of the auxiliary reflection surface R2 is selected such that the average value of the correlated color temperature of the second light L2 is lower than the average value of the correlated color temperature of the first light L1 (such that the former exhibits a warmer color than the latter). In this way, it is possible to reduce the uneven color temperatures more reliably and to suppress the color unevenness on the illuminated surface IR. When the average value of the correlated color temperature of the first light L1 is around 4000 K, for example, it is possible to reduce the uneven color temperatures by providing the auxiliary reflection surface R2 with the above-mentioned ivory matte paint. Thus, the variation in correlated color temperature, which is around 250 K in the case of proving the auxiliary reflection surface R2 with white paint (Munsell N9.5), for example, can be reduced down to around 70 K.

Furthermore, the correlated color temperature of the source light is made variable in a predetermined range (such as from 3000 K to 5000 K), a median value of which is a first correlated color temperature (such as 4000 K), by changing the light output ratio between the first and second LEDs 31 and 32. If the source light is set to the first correlated color temperature (the median value of the variable range), the light output ratio between the first and the second LEDs 31 and 32 comes close to 1, whereby the magnitude of the uneven color temperatures of the first light L1 projected on the far region FR and the near region NR is apt to be maximized.

In this case, the color of the auxiliary reflection surface R2 is selected such that the average value of the correlated color temperature of the second light L2 is lower than the average value of the correlated color temperature of the first light L1 when the correlated color temperature of the source light is equal to the first correlated color temperature. This makes it is possible to efficiently suppress the maximum value of the uneven color temperatures in the variable range of the correlated color temperature.

Meanwhile, in the lighting device 1, the light shielding plate 5 is provided with the auxiliary reflection surface R2. For this reason, it is possible to obtain the aforementioned color unevenness reduction effect in a space-efficient manner while preventing the light source 3 from becoming visible directly through the light projection opening 2B.

Moreover, the lighting device 1 is provided with the diffuser panel 6, which is configured to perform the diffuse projection of the incident light toward the far region FR and the near region NR, and to reflect part of the incident light. Accordingly, it is possible to improve the uniformity ratio on the illuminated surface IR and to increase the amount of the second light L2 by augmenting the secondary and higher-order reflection light in the lighting device 1.

Next, lighting devices according to some other embodiments of this disclosure will be described. Note that the constituents which are the same as those in the configuration of the aforementioned embodiment will be denoted by the same reference numerals and explanations thereof will be omitted.

In a certain embodiment, the uneven color temperature of the first light L1 may show a reverse trend to that in the above-described embodiment. Specifically, the correlated color temperature of the first light L1 projected on the far region FR may be higher than the correlated color temperature of the first light L1 projected on the near region NR.

In this case as well, the color of the auxiliary reflection surface R2 is selected such that the absolute value of the difference in correlated color temperature between the mixed light projected on the near region NR and the first light L1 projected on the far region FR is smaller than the magnitude of the uneven color temperatures of the first light L1. In other words, the lighting device 1 generates the light (the second light L2) to reduce the difference in correlated color temperature of the light projected on the far region FR and the near region NR on the illuminated surface IR by tinting the second reflection surface R2 in a prescribed color, and projects the generated light on the near region NR. This makes it possible to reduce the uneven color temperatures of the light projected on the far region FR and the near region NR by using a simple structure, and thus to efficiently suppress the color unevenness on the illuminated surface IR.

The color of the auxiliary reflection surface R2 is preferably selected such that the average value of the correlated color temperature of the second light L2 is higher than the average value of the correlated color temperature of the first light L1 (such that the former exhibits a colder color than the latter). This makes it possible to reduce the uneven color temperatures more reliably and to suppress the color unevenness on the illuminated surface IR. For example, when the average value of the correlated color temperature of the first light L1 is around 4000 K, the uneven color temperatures can be reduced by providing the auxiliary reflection surface R2 with hisoku matte paint or very pale blue matte paint (Munsell 5B 9/2, which corresponds to 65-90D according to JPMA).

In another certain embodiment, the correlated color temperature of the source light is made variable within a predetermined range (such as from 3000 K to 5000 K). In this case, the color of the auxiliary reflection surface R2 may be selected such that the average value of the correlated color temperature of the second light L2 is higher than the average value of the correlated color temperature of the first light L1, when the correlated color temperature of the source light is equal to a median value (such as 4000 K) of the variable range. Thus, it is possible to efficiently suppress the maximum value of the uneven color temperatures in the variable range of the correlated color temperature.

Meanwhile, in a modified example of each of the embodiments described above, the auxiliary reflection surface R2 may be provided with different colors depending on positions in the longitudinal direction of the lighting device 1. Such colors may be changed either stepwise or gradually in the longitudinal direction of the lighting device 1. In this way, when the uneven color temperatures of the first light L1 vary depending on the positions in the longitudinal direction of the lighting device 1, it is possible to generate the second light L2 in an optimal correlated color temperature so as to correspond to the positions in the longitudinal direction.

In another modified example of each of the embodiments described above, the auxiliary reflection surface R2 may be provided with different colors depending on positions in a direction (a width direction of the auxiliary reflection surface R2) orthogonal to the longitudinal direction of the lighting device 1. Such colors may be changed either stepwise or gradually in the direction orthogonal to the longitudinal direction of the lighting device 1. This makes it possible to reduce the uneven color temperatures of the light projected on the illuminated surface IR at a higher accuracy.

In still another modified example of each of the embodiments described above, a second auxiliary reflection surface may be provided in addition to the auxiliary reflection surface R2. This makes it possible to reduce the uneven color temperatures of the light projected on the illuminated surface IR at an even higher accuracy by projecting a third light different from the first light L1 and the second light L2 on a third region different from the far region FR and the near region NR.

While the foregoing is described as what are considered to be the best mode and/or other examples, it is understood that various modifications may be made therein, and that the subject matter disclosed herein may be implemented in various forms and examples, and that they may be applied in numerous applications.

For example, in the above-described embodiments, the light source 3 is formed from two types of the LEDs 31 and 32 which have the correlated color temperatures of the emitted light being different from each other. However, the number of types of the LEDs 30 may be three or more. Meanwhile, the light-emitting elements of the light source 3 may be formed from other semiconductor elements such as organic EL elements (OLEDs).

In the meantime, the lighting device 1 of each of the above-described embodiments is installed above and in front of the illuminated surface IR. Instead, the lighting device 1 may be installed below and in front of the illuminated surface IR, and may project the illumination light L from that position upward and rearward. The lighting device 1 may be installed either on the front left or on the front right of the illuminated surface IR, and may project the illumination light L from there toward the center of the illuminated surface IR. The lighting devices 1 may be annularly disposed so as to surround the illuminated surface IR. Alternatively, the lighting devices 1 may be arranged and installed in two or more rows in the direction orthogonal to longitudinal directions thereof.

Moreover, the lighting device 1 of each of the above-described embodiments is disposed substantially parallel to the illuminated surface IR. Instead, the lighting device 1 may be disposed nonparallel to the illuminated surface IR. In the meantime, the shape of the lighting device 1 is not limited to the linear shape but may be formed into a curved shape instead.

Furthermore, the lighting device 1 of each of the above-described embodiments is applicable not only to the lighting of the showcase 10 but also to the lighting of an open display.

As described above, the lighting device 1 according to each embodiment of this disclosure is disposed extending along the illuminated surface IR, and illuminates the far region FR (the first region) and the near region NR (the second region) constituting the illuminated surface IR at the prescribed correlated color temperature. The near region NR is located closer to the lighting device 1 than the far region FR. The lighting device 1 includes the light source 3, in which the two or more types of the LEDs 30 (the light-emitting elements) that have correlated color temperatures of the emitted light being different from each other are arranged in one direction. Moreover, the lighting device 1 includes the specular reflection surface R1 (the first reflection surface), which reflects the source light emitted from the light source 3, and projects the first light L1 on the far region FR and the near region NR. Furthermore, the lighting device 1 includes the auxiliary reflection surface R2 (the second reflection surface), which reflects the secondary and higher-order reflection light of the source light, and projects the second light L2 on the near region NR. The auxiliary reflection surface R2 is tinted in the prescribed color. The absolute value of the difference in correlated color temperature between the first light L1 projected on the far region FR and the mixed light of the first and second lights L1 and L2 projected on the near region NR is smaller than the absolute value of the difference in the correlated color temperature between the first light L1 projected on the far region FR and the first light L1 projected on the near region NR.

The correlated color temperature of the first light L1 projected on the far region FR is lower than the correlated color temperature of the first light L1 projected on the near region NR, and the average value of the correlated color temperature of the second light L2 is smaller than the average value of the correlated color temperature of the first light L1.

The two or more types of the LEDs 30 are formed from the first LEDs 31 (the first light-emitting elements) and the second LEDs 32 (the second light-emitting elements). The first LEDs 31 and the second LEDs 32 have correlated color temperatures of the emitted light being different from each other. The lighting device 1 includes the control unit 9, which controls the light outputs from the first and second LEDs 31 and 32. The control unit 9 changes the light output ratio between the first and second LEDs 31 and 32, thereby making the correlated color temperature of the source light variable in the prescribed range having its median value at the first correlated color temperature. When the correlated color temperature of the source light is equal to the first correlated color temperature, the correlated color temperature of the first light L1 projected on the far region FR is lower than the correlated color temperature of the first light L1 projected on the near region NR, and the average value of the correlated color temperature of the second light L2 is lower than the average value of the correlated color temperature of the first light L1.

In a certain embodiment, the correlated color temperature of the first light L1 projected on the far region FR may be higher than the correlated color temperature of the first light L1 projected on the near region NR, and the average value of the correlated color temperature of the second light L2 may be higher than the average value of the correlated color temperature of the first light L1.

Moreover, in this certain embodiment, the two or more types of the LEDs 30 are formed from the first LEDs 31 (the first light-emitting elements) and the second LEDs 32 (the second light-emitting elements). The first LEDs 31 and the second LEDs 32 have the correlated color temperatures of the emitted light being different from each other. The lighting device 1 includes the control unit 9, which controls the light outputs from the first and second LEDs 31 and 32. The control unit 9 changes the light output ratio between the first and second LEDs 31 and 32, thereby making the correlated color temperature of the source light variable in the prescribed range having its median value at the first correlated color temperature. When the correlated color temperature of the source light is equal to the first correlated color temperature, the correlated color temperature of the first light L1 projected on the far region FR is higher than the correlated color temperature of the first light L1 projected on the near region NR, and the average value of the correlated color temperature of the second light L2 is higher than the average value of the correlated color temperature of the first light L1.

The lighting device 1 according to each of the above-described embodiments may include the light shielding plate 5, which suppresses projection of the source light on the far region FR and the near region NR without being reflected from the specular reflection surface R1, and the light shielding plate 5 is provided with the auxiliary reflection surface R2.

Moreover, the lighting device 1 according to each of the above-described embodiments may include the diffuser panel 6, which diffuses the light incident from the specular reflection surface R1 and projects the diffused light toward the far region FR and the near region NR.

The entire content of Japanese Patent Application No. 2017-001632 (filed on Jan. 10, 2017) is incorporated herein by reference.

The invention claimed is:

1. A lighting device comprising:

a light source including at least two types of light-emitting elements arranged in one direction, the at least two types of light-emitting elements having correlated color temperatures of emitted light being different from each other;

a first reflection surface configured to reflect source light emitted from the light source, and project first light that is the reflected source light, on first and second regions on a surface illuminated by the lighting device, the second region being located closer to the lighting device than the first region; and a second reflection surface tinted in a prescribed color and configured to reflect secondary and higher-order reflection light of the source light, and project second light that is the reflected secondary and higher-order reflection light, on the second region, wherein an absolute value of a difference between a correlated color temperature of the first light projected on the first region and a correlated color temperature of mixed light of the first and second lights projected on the second region, is smaller than an absolute value of a difference between the correlated color temperature of the first light projected on the first region and a correlated color temperature of the first light projected on the second region.

2. The lighting device according to claim 1, wherein the correlated color temperature of the first light projected on the first region is lower than the correlated color temperature of the first light projected on the second region, and an average value of the correlated color temperature of the second light is lower than an average value of the correlated color temperature of the first light.

3. The lighting device according to claim 2, wherein the at least two types of light-emitting elements include a first light-emitting element and a second light-emitting element, the first and second light-emitting elements have the correlated color temperatures of the emitted light being different from each other, the lighting device includes a control unit configured to control light outputs from the first and second light-emitting elements, the control unit makes a correlated color temperature of the source light variable in a prescribed range, a median value of which is a first correlated color temperature, by changing light output ratio between the first and second light-emitting elements, and when the correlated color temperature of the source light is equal to the first correlated color temperature, the correlated color temperature of the first light projected on the first region is lower than the correlated color temperature of the first light projected on the second region, and the average value of the correlated color temperature of the second light is lower than the average value of the correlated color temperature of the first light.

4. The lighting device according to claim 1, wherein the correlated color temperature of the first light projected on the first region is higher than the correlated color temperature of the first light projected on the second region, and an average value of the correlated color temperature of the second light is higher than an average value of the correlated color temperature of the first light.

5. The lighting device according to claim 4, wherein the at least two types of light-emitting elements include a first light-emitting element and a second light-emitting element, the first and second light-emitting elements have the correlated color temperatures of the emitted light being different from each other, the lighting device includes a control unit configured to control light outputs from the first and second light-emitting elements, the control unit makes a correlated color temperature of the source light variable in a prescribed range, a median value of which is a first correlated color temperature, by changing light output ratio between the first and second light-emitting elements, and when the correlated color temperature of the source light is equal to the first correlated color temperature, the correlated color temperature of the first light projected on the first region is higher than the correlated color temperature of the first light projected on the second region, and the average value of the correlated color temperature of the second light is higher than the average value of the correlated color temperature of the first light.

6. The lighting device according to claim 1, further comprising:

a light shielding plate configured to suppress projection of the source light on the first and second regions without being reflected from the first reflection surface, wherein the second reflection surface is provided to the light shielding plate.

7. The lighting device according to claim 1, further comprising:

a diffuser panel configured to diffuse light incident from the first reflection surface and project the diffused light toward the first and second regions.

* * * * *